US012503880B2

(12) United States Patent
Viberg

(10) Patent No.: US 12,503,880 B2
(45) Date of Patent: Dec. 23, 2025

(54) HEAVY-DUTY BARRIER

(71) Applicant: Worxsafe AB, Östersund (SE)

(72) Inventor: Olov Viberg, Östersund (SE)

(73) Assignee: WORXSAFE AB, Ostersund (SE)

( * ) Notice: Subject to any disclaimer, the term of this patent is extended or adjusted under 35 U.S.C. 154(b) by 565 days.

(21) Appl. No.: 17/911,911

(22) PCT Filed: Mar. 19, 2021

(86) PCT No.: PCT/EP2021/057100
§ 371 (c)(1),
(2) Date: Sep. 15, 2022

(87) PCT Pub. No.: WO2021/186039
PCT Pub. Date: Sep. 23, 2021

(65) Prior Publication Data

US 2023/0175286 A1 Jun. 8, 2023

(30) Foreign Application Priority Data

Mar. 19, 2020 (WO) ..... PCT/EP2020/057668

(51) Int. Cl.
*E04H 17/18* (2006.01)
*E01F 13/02* (2006.01)
(Continued)

(52) U.S. Cl.
CPC ..... *E04H 17/18* (2013.01); *E01F 13/022* (2013.01); *E01F 13/04* (2013.01); *E04H 17/013* (2021.01)

(58) Field of Classification Search
CPC ..... E04H 17/18; E04H 17/185; E04H 17/14; E04H 17/1413; E04H 17/16; E01F 13/02; E01F 13/022
See application file for complete search history.

(56) References Cited

U.S. PATENT DOCUMENTS 4,008,575 A * 2/1977 Gallagher ..... E02B 15/0814 403/326
5,402,988 A * 4/1995 Eisele ..... E01F 13/022 256/73

(Continued)

FOREIGN PATENT DOCUMENTS

DE 10311590 A1 9/2004
DE 202012102366 U1 8/2012

(Continued)

OTHER PUBLICATIONS

International Search Report and Written Opinion of the International Searching Authority dated May 27, 2021 for PCT International Application No. PCT/EP2021/057100.

*Primary Examiner* — Jonathan P Masinick
(74) *Attorney, Agent, or Firm* — Volpe Koenig

(57) ABSTRACT

A heavy-duty barrier, which is movable, comprising a base part, which comprises a ballast, and a fence part attached to the base part. The fence part comprises a fixed bar structure and a rigid connection element, which is movably attached to the bar structure, and which is connectable with a complementary connection element of a neighboring heavy-duty barrier. The connection element comprises an attachment portion movably attached to a bar portion of the bar structure, and a hook portion arranged to be engaged with a corresponding hook portion of the complementary connection element.

13 Claims, 6 Drawing Sheets

(51) Int. Cl.
*E01F 13/04* (2006.01)
*E04H 17/00* (2006.01)

(56) References Cited

U.S. PATENT DOCUMENTS

| | | | | | |
|---|---|---|---|---|---|
| D1,056,247 | S | * | 12/2024 | Viberg | D25/48.8 |
| D1,056,248 | S | * | 12/2024 | Viberg | D25/48.8 |
| 2007/0210293 | A1 | * | 9/2007 | Cheng | E04H 17/18 256/26 |
| 2023/0120075 | A1 | * | 4/2023 | Viberg | E01F 13/04 256/25 |

FOREIGN PATENT DOCUMENTS

| | | | |
|---|---|---|---|
| EP | 0844335 | A1 | 5/1998 |
| EP | 1279771 | A2 | 1/2003 |
| EP | 1279771 | A3 | 12/2003 |
| EP | 1447478 | A1 | 8/2004 |
| FR | 2312602 | A1 | 12/1976 |

* cited by examiner

HEAVY-DUTY BARRIER

FIELD OF THE INVENTION

The present invention relates to the field of heavy-duty barriers, wherein the heavy-duty barrier has a base part of concrete, or which is fillable with concrete, and a fence part attached to the base part, wherein the fence part comprises a bar structure.

BACKGROUND OF THE INVENTION

A heavy-duty barrier of the kind relevant for this application is a barrier that is used to prevent people from entering a worksite and that is substantially heavier and more stable, and thereby provides a substantially higher safety, than a simple fence. Typically, the work is repair, maintenance or construction work on a road or on building, but it can be any activity that necessitates entrance restriction. The heavy-duty barrier is supposed to be able to stop a person falling against it without overturning. In order to obtain this, the heavy-duty barrier has a lower part, or base part, which is heavy and constitutes a ballast. Typically, the base part consists of concrete or of a metal tub filled with concrete, but other solutions exist as well. The heavy-duty barrier further comprises an upper part, which acts as a fence and consists of a bar structure. The upper part, or fence part, is attached to the base part, for instance by having bottom ends cast into the concrete or being attached to the concrete or to the tub.

Most often several heavy-duty barriers are positioned in a row, i.e. side by side, in order to block an area, and then they are interconnected by means of chains attached to their base parts. This possibility to interconnect the barriers is helpful in that it enhances the ability of the barrier to withstand a force trying to move it by pushing on the base part, since one or more other barriers will have to be moved in common with the barrier subjected to the force. In reality, although the heavy-duty barrier is only tested for persons falling against it which is communicated by the manufacturers, users of the heavy-duty barrier often believe that it is capable of withstanding larger forces than a person falling against it without overturning, since it is perceived as heavy and stable. That user perception causes wrong use, which in turn generates a risk of accidents.

SUMMARY OF THE INVENTION

It would be advantageous to enhance the capability of the heavy-duty barrier to reduce the risk of accident due to excessive reliance in the capability of the heavy-duty barrier.

To address this concern, in a first aspect of the invention there is presented a heavy-duty barrier, which is movable, comprising a base part, which comprises a ballast, and a fence part attached to the base part, wherein the fence part comprises a fixed bar structure and a rigid first connection element, which is movably attached to the bar structure, wherein the first connection element comprises an attachment portion, movably attached to a bar portion of the bar structure and encircling at least a major part of the circumference of the bar portion, and a hook portion arranged to be engaged with a complementary hook portion of a rigid connection element of a neighbouring heavy-duty barrier. By means of this connection element a simple to use and strong interconnection of neighbouring heavy-duty barriers has been obtained. It takes a lot more force to overturn the heavy-duty barrier when it is more rigidly interconnected with one or more other heavy-duty barriers than when merely connected with the prior art chain. It has even been proven that for heavy-duty barriers of a size that is commonly used the connection element make them capable of even withstanding a hit by a car. It should be noted that the definition of the connection element as rigid does not exclude flexible or pivotable parts from being included, while the overall structure is still considered to be rigid. This contrasts with a chain, which is considered non-rigid, i.e. flexible, while still including many rigid elements, i.e. the individual links of the chain.

In accordance with an embodiment of the heavy-duty barrier the movable attachment of the attachment portion includes rotation of the first connection element about a longitudinal centre axis of the bar portion. Thereby, arrangement of neighbouring heavy-duty barriers at different angles to each other is facilitated.

In accordance with an embodiment of the heavy-duty barrier the movable attachment of the attachment portion includes movement along a length of the bar portion. Thereby, accommodation of unevenness of the ground is enhanced.

In accordance with an embodiment of the heavy-duty barrier the attachment portion is tubular. This provides a simple yet reliable attachment of the connection element to the fixed bar structure.

In accordance with an embodiment of the heavy-duty barrier the hook portion comprises a first protrusion protruding from the attachment portion, and a second protrusion protruding from the attachment portion, wherein the first and second protrusions define a gap between them, which gap is arranged to receive a part of a first protrusion of the first connection element of a neighbouring heavy-duty barrier.

In accordance with an embodiment of the heavy-duty barrier the first protrusion has an L-shaped cross-section, and a free end of the first protrusion faces the second protrusion.

In accordance with an embodiment of the heavy-duty barrier the first connection element is rotatably movable around the bar portion between several rotatably fixed positions. Thereby, the stability of the interconnection of the heavy-duty barriers is further increased.

In accordance with an embodiment of the heavy-duty barrier the first connection element is arranged to be movable between the fixed positions by means of a combination of longitudinal movement and rotational movement. Thereby, a simple setting of the first connection element in different positions while being securely kept in the fixed position can be obtained.

In accordance with an embodiment of the heavy-duty barrier, it comprises a rotation blocking element fixedly arranged at the bar portion below the first connection element and arranged to engage with the connection element to block rotation thereof.

In accordance with an embodiment of the heavy-duty barrier the attachment portion comprises first protrusions extending downwards.

In accordance with an embodiment of the heavy-duty barrier it comprises a rotation blocking element fixedly attached to the bar portion below the first connection element, and the rotation blocking element comprises second protrusions extending upwards and engaging with the first protrusions.

In accordance with an embodiment of the heavy-duty barrier the attachment portion comprises first protrusions extending downwards and arranged to engage with the bar structure to block rotational movement of the connection element.

In accordance with an embodiment of the heavy-duty barrier the first connection element is freely rotatable to any position.

In accordance with an embodiment of the heavy-duty barrier it comprises a rigid second connection element, wherein the first and second connection elements are arranged at opposite ends of the heavy-duty barrier, and wherein the second connection element is fixedly attached to the bar structure and is connectable with at least such a first connection element of a neighbouring heavy-duty barrier.

BRIEF DESCRIPTION OF THE DRAWINGS

The invention will now be described in more detail and with reference to the appended drawings in which.

DESCRIPTION OF EMBODIMENTS

Figure 1:
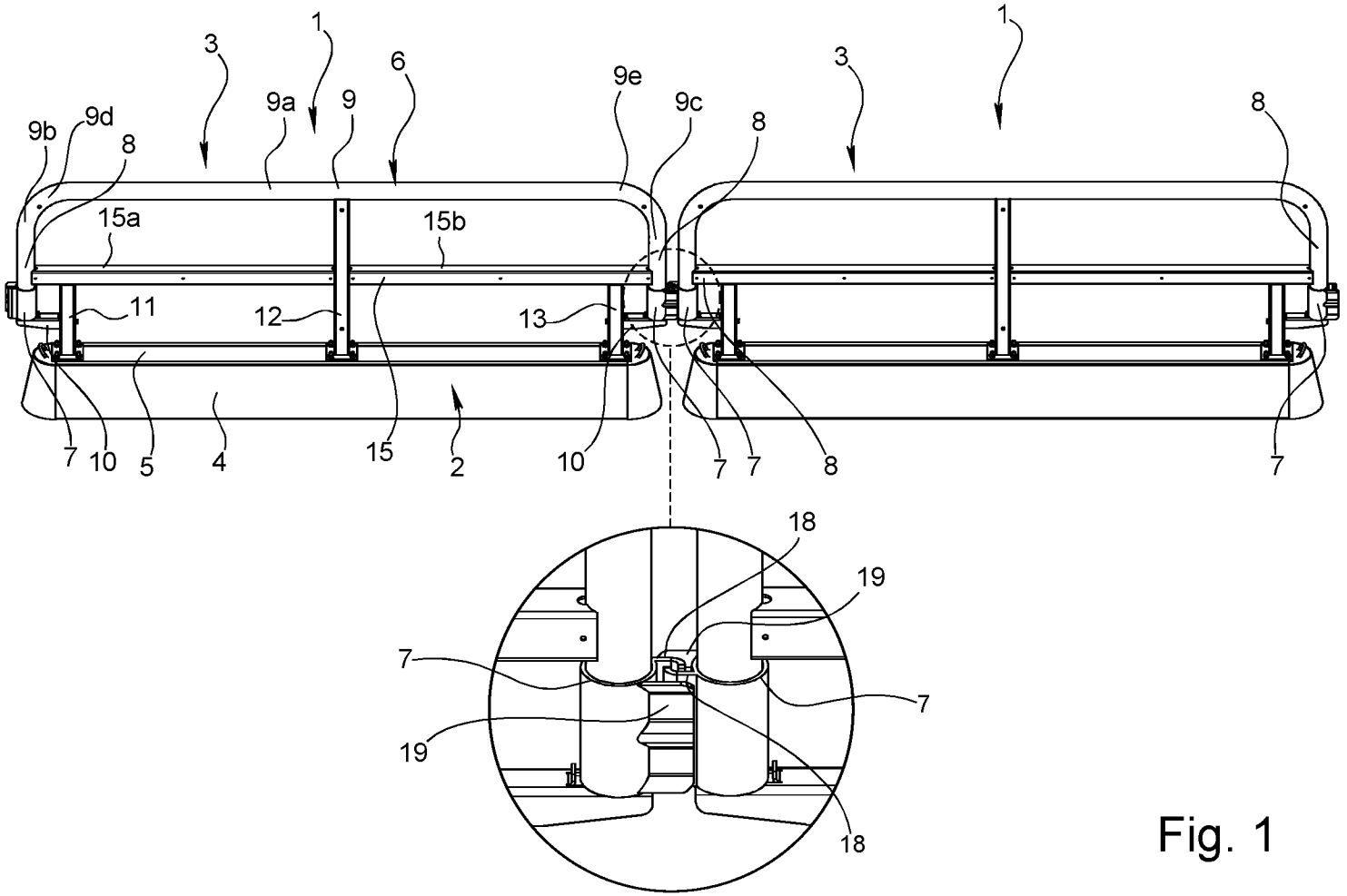
FIG. 1 is a perspective view of two interconnected heavy-duty barriers according to an embodiment of the present invention.

An embodiment of the heavy-duty barrier 1 comprises a base part 2, and a fence part 3, which is attached to the base part 2. The base part 2 comprises a steel tub 4 and a concrete ballast 5, which has been cast into the steel tub 4 to provide the heavy-duty barrier with a level of resistance against overturning, i.e. falling over, when hit by a force, such as caused by a strong wind or by a person falling on the fence part 3. The base part 2 is elongated, having a length of for example about 1-3.5 m, or even more, a width of for example about 0.2-0.4 m, and a height of for example 0.2-0.4 m. The total height of the heavy-duty barrier 1 may be about 1-1.2 m. Example weights of the heavy-duty barrier 1 are 200-500 kg. A typical example of the heavy-duty barrier 1 has a length of about 3 m, a width of about 0.3 m, a height of about 1.1 m, and a weight of about 450 kg. As an alternative base part structure, a concrete ballast can be cast in a mold and then used as the base part without the steel tub.

The fence part 3 comprises a bar structure 6, typically comprising tubular bars, typically with a square or circular cross-section, and two connection elements 7, one at each end of the heavy-duty barrier 1. The connection elements 7 are rigid. In this embodiment, the connection elements 7 are similar, and they will additionally be referred to as first connection elements 7. In other embodiment the connection elements may be different and will additionally be referred to as first and second connection elements. The bar structure 6 comprises a bar portion 8 at each end of the heavy-duty barrier 1, at which the connection element 7 is movably mounted. For the purposes of this application, in a most simple embodiment a single connection element 7 is feasible. The bar portion 8 is a vertical portion, and in the embodiments shown in the drawings it is an end portion of an upper bar 9, which has a major portion 9*a* extending horizontally above the base part 2, end portions 9*b*, 9*c* extending vertically at the ends of the base portion 2, and bent portions 9*d*, 9*e* integrally connecting the vertical end portions 9*b*, 9*c* with the horizontal major portion 9*a*. Thus, the end portions 9*b*, 9*c* of the upper bar 9 provide the bar portions 8 where the connection elements 7 have been mounted.

Furthermore, the fence part 3 comprises two locking elements 10, one at each connection element 7. Each locking element 10 prevents the connection element 7 from falling off the bar portion 8 at which it is mounted. In this embodiment, more particularly, the locking element 10 extends between the very end of the end portion 9*b*, 9*c* and a vertical end post 11 and 13, respectively, also being comprised in the bar structure 6 and being attached to the base part 2 at its ends. The vertical end post 11, 13 is displaced towards a centre of the heavy-duty barrier 1 relative to the adjacent bar portion 8, with which it is connected by means of the locking element 10. Additionally, the bar structure 6 comprises a middle post 12, and a lower bar 15. The lower bar 15 extends horizontally and is located between the upper bar 9 and the base part 2. More particularly, the lower bar 15 comprises two halves 15*a*, 15*b*, one half 15*a* extending from the middle post 12 to one end portion 9*b* of the upper bar 9, and the other half 15*b* extending in the opposite direction, from the middle post 12 to the other end portion 9*c* of the upper bar 9. The middle post 12 reaches from the base part 2 up to the upper bar 9. The vertical end posts 11, 13 extend from the base part 2 up to the respective half 15*a*, 15*b* of the lower bar 15.

The connection element 7 comprises an attachment portion 16, and a hook portion 17. The attachment portion 16 is tubular and has a slightly larger inner diameter than the outer diameter of the bar portion 8 which the attachment portion 16 encircles. In other words, the attachment portion 16 is concentric with the bar portion 8 and there is a play between the outer surface of the bar portion 8 and the inner surface of the attachment portion 16. The bar portion 8 has a circular cross-section, and so has the attachment portion 16. The attachment portion 16 has a longitudinal centre axis C-C, which coincides with a longitudinal centre axis of the bar portion 8. Thus, the connection element 7 is rotatable about the bar portion 8, and more particularly about the centre axis of the bar portion 8. Additionally, there is room to move the connection element 7 along the length of the bar portion 8, i.e. vertically. The hook portion 17 comprises a first protrusion 18 protruding from the attachment portion 16, and a second protrusion 19 protruding from the attachment portion. The first and second protrusion 18, 19 define a gap 20 between them, which gap 20 is arranged to receive a part of a first protrusion 18 of another connection element 7. The first and second protrusions 18, 19 generally protrude laterally from the attachment portion 16, and they have a substantial vertical extension, thereby forming opposite first and second walls, respectively. The first protrusion 18 has an L-shaped cross-section, i.e. a cross-section taken perpendicular of the centre axis C-C of the attachment portion 16. The longer portion of the L is attached to the attachment portion 16. A free end of the first protrusion 18, i.e. the end of the shorter portion of the L, faces the second protrusion 19, and more particularly the surface of the second protrusion 19 that faces the gap, which surface can be defined as an inner surface of the second protrusion 19. Furthermore, a height of the connection element 7 is defined as its extension in the direction of the centre axis C-C. The second protrusion, or second wall, 19 is provided with a chute, or bent portion, 21 at the middle of the height of the second protrusion 19. The chute 21 extends from the attachment portion 16 to the freed edge of the second protrusion 19, and is, for example, V-shaped. The chute strengthens the second portion 19, which is generally plate shaped. The second protrusion 19 further comprises an upper edge portion 22 and a lower edge portion 23, which are bent outwards, i.e. away from the opposite portions of the first protrusion 18. Thereby, the gap between the first and second protrusions 18, 19 increases towards the upper and lower ends of the connection element 7, which facilitates interconnection of two connection elements 7.

When two heavy-duty barriers 1 are to be interconnected, the first heavy-duty barrier is put in place on the ground. Then, the second heavy-duty barrier 1 is lifted and moved close to the first heavy-duty barrier, and the connection elements 7 of both heavy-duty barriers 1, at their adjacent ends, are aligned with each other. Then, the second heavy-duty barrier is lowered such that its connection element 7 is engaged with the connection element 7 of the adjacent first heavy-duty barrier 1. Thereby the heavy-duty barriers 1 become interconnected as shown in FIG. 1. Another way of interconnecting the heavy-duty barriers 1 is to start with placing the heavy-duty barriers 1 side by side adjacent to each other and in a position that allows retrofitting of the connection elements 7. This means that the connection elements 7 and the locking elements 10 are not mounted on the heavy-duty barriers 1 until after they have been positioned on the ground. How this can be done is understood by the person skilled in the art from the drawings and the above description and will not be elaborated in detail, but, for instance, the locking element 10 can be detached to allow mounting of the connection elements 7 and then reattached. In alternative embodiments, the connection element can be provided with a two-part attachment portion having a demountable semi-cylindrical part. Then the connection element can be mounted also on a bar portion having no accessible free end.

Figure 2:
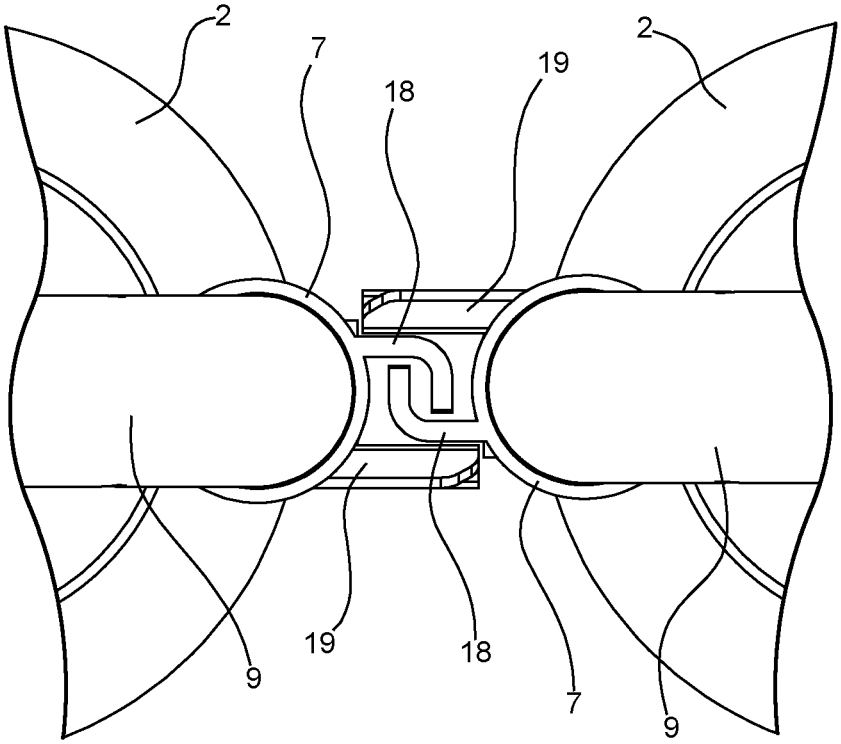
FIG. 2 is an enlarged view from above of a part of the heavy-duty barrier shown in FIG. 1.
Figure 3:
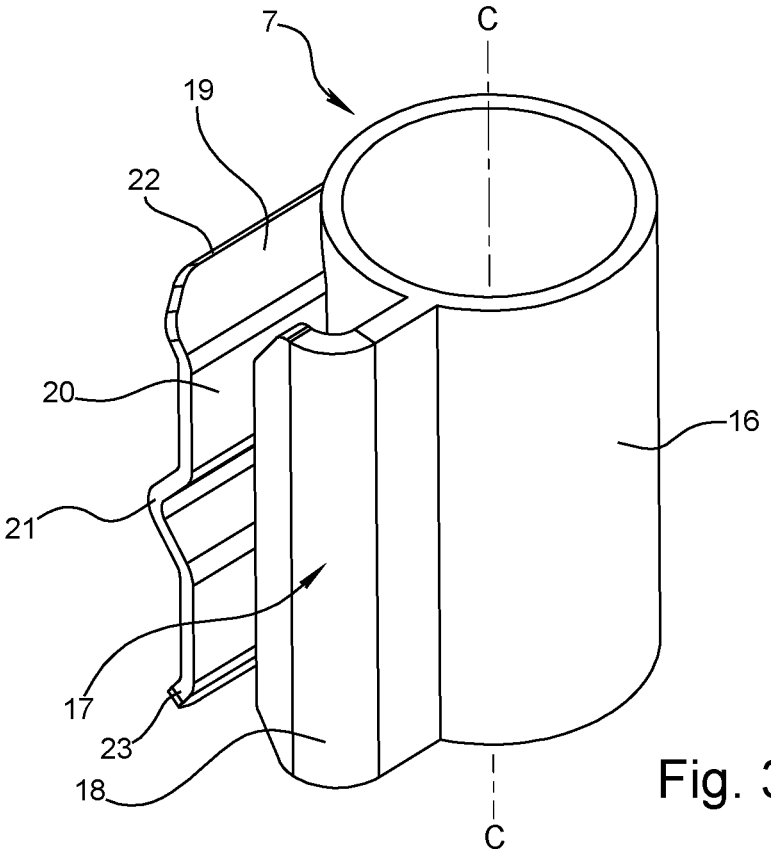
FIG. 3 is a perspective view of a connection element, which is part of the heavy-duty barrier shown in FIG. 1.

Thus, as shown in FIGS. 1 and 2, when a heavy-duty barrier 1 has been interconnected with a neighbouring heavy-duty barrier 1, the hook portion 17 of the connection element 7 of the heavy-duty barrier 1 is engaged with the hook portion 17 of a complementary hook portion 17 of the adjacent connection element 7 of the neighbouring heavy-duty barrier 1. In this embodiment the hook portion 17 and the complementary hook portion 17 are identical, and the hook portion 17 is shaped such that the hook portions 17 o two separate connection elements 7 are able to move into engagement with each other when turned towards each other.

Due to the rotatability and movability along the bar portion 8, it is possible to position the heavy-duty barriers 1 at an angle to each other, and a certain ground unevenness is allowed as well. This movability can be slightly enhanced by providing play between the protrusions 18, 19 of the interconnected connection elements 7.

Figure 4:
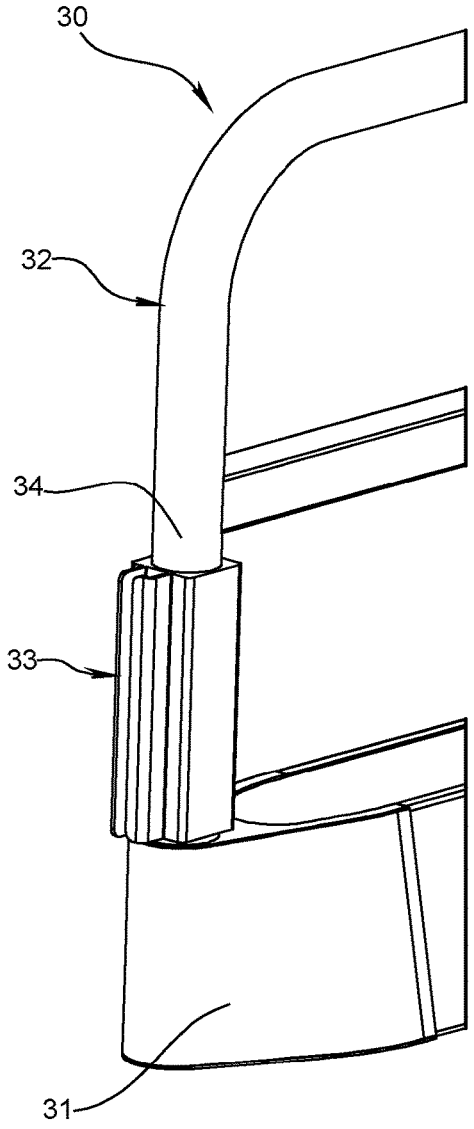
FIGS. 4 to 12 show further embodiments of the heavy-duty barrier.
Figure 5:
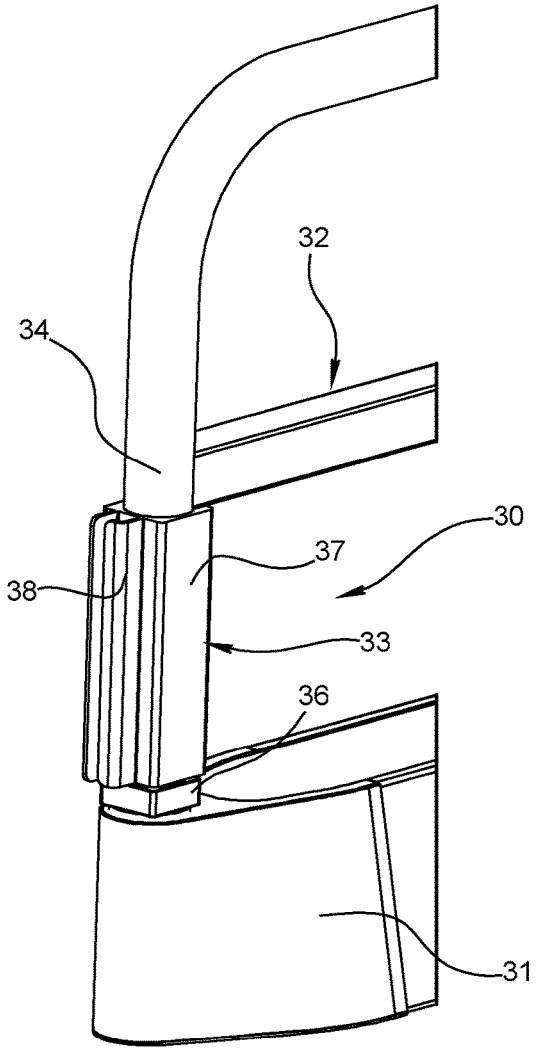

According to an embodiment of the heavy-duty barrier 30, shown in FIGS. 4 and 5, having a base part 31 and a fence part 32, the connection element, or first connection element, 33 is movably attached to the bar portion 34 such that the connection element 33 is rotatable between several rotationally fixed positions. In order to obtain this the heavy-duty barrier 30 further comprises a rotation blocking element 36, which has been fixedly arranged, e.g. fixedly attached to the bar portion 34 or to the base part 31, at a lower end of the bar portion 34. The connection element 33 comprises the attachment portion 37 and the hook portion 38. The attachment portion 37 is tubular with a square cross-section, and the rotation blocking element 36 has a square periphery. The bar portion 34 has a circular cross-section. Inner measures of the attachment portion 37, at least at a lower end thereof, are slightly larger than outer measures of the rotation blocking element 36. Thereby, in a fixed position, the attachment portion 37 encloses the rotation blocking element 36, which consequently prevents the connection element 33 from being rotated. To the contrary, in a rotatable position, where the connection element 33 has been lifted, i.e. has been moved along the bar portion 34, above the rotation blocking element 36, the connection element 33 is freely rotatable about the bar portion 34. In other words, the connection element 33 is vertically adjustable between a fixed position, where it is rotationally fixed, and a rotatable position. Consequently, the connection element 33 is settable in four different rotationally fixed positions, with 90 degrees rotation angle between any two adjacent rotationally fixed positions. According to this embodiment, while still allowing adjacent heavy-duty barriers 30 to be arranged either in alignment with each other or at an angle to each other, the strength of the structure of interconnected heavy-duty barriers 30 is higher than a structure of interconnected heavy-duty barriers according to the above-described embodiment. However, this advantage comes with a drawback of losing the possibility of arranging the heavy-duty barriers 30 with an arbitrary angle between two adjacent heavy-duty barriers 30. That is, arbitrary within a large interval only limited by the base parts 31 of the adjacent heavy-duty barriers 30 hitting each other.

Figure 6:
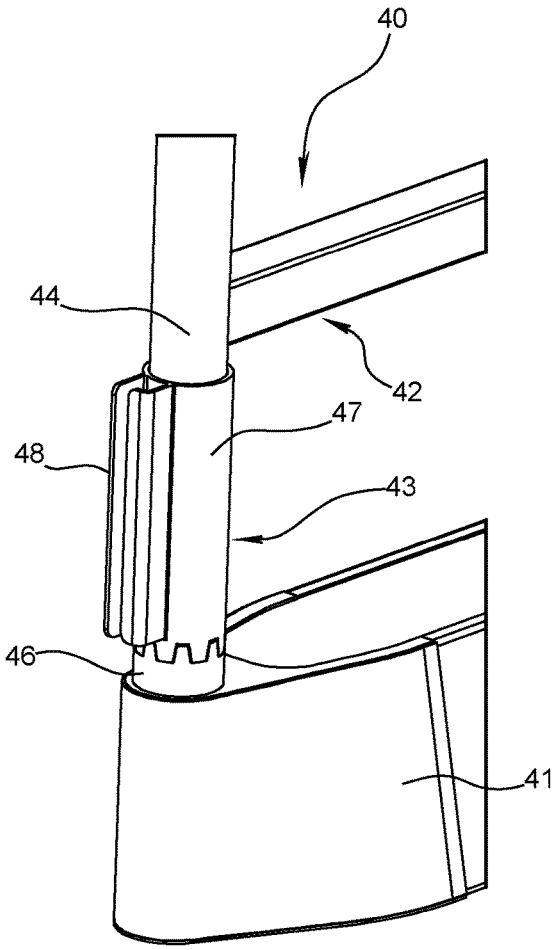
Figure 7:
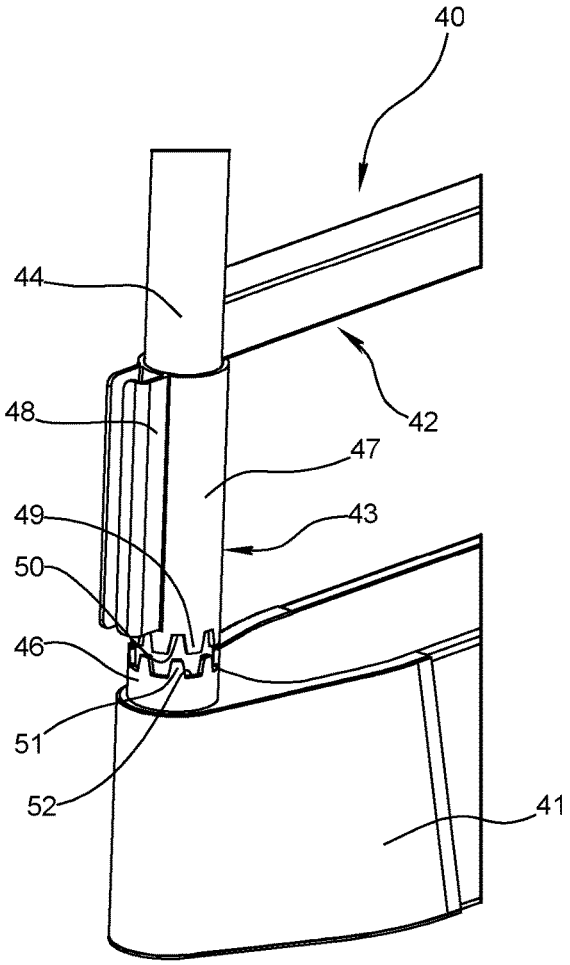

According to an embodiment of the heavy-duty barrier 40, shown in FIGS. 6 and 7, having a base part 41 and a fence part 42, the connection element, or first connection element, 43 is movably attached to the bar portion 44 such that the connection element 43 is rotatable between several fixed positions. The heavy-duty barrier 40 further comprises a rotation blocking element 46, which has been fixedly mounted at a lower end of the bar portion 44. The connection element 43 comprises the attachment portion 47 and the hook portion 48. The attachment portion 47 is tubular and is mounted concentrically of the bar portion 44, and both have circular cross-sections. Furthermore, the connection element 43 is provided with first protrusions 49 and indents 50 at a lower end thereof. The first protrusions 49 and indents are alternatingly and equidistantly arranged along the circumference of the connection element 43. The rotation blocking element 46 is similarly provided with complementary, or matching, second protrusions 51 and indents 52. Thus, in a rotatably fixed position the first protrusions 49 of the connection element 43 have been received in the indents 52 of the rotation blocking element 46, and vice versa, thereby preventing rotation of the connection element 43. In other words, in the rotatably fixed position the first protrusions 49 are engaged with the second protrusions 51. The connection element 43 is vertically movable to a rotatable position where the first protrusions 49 do not extend into the indents 52. Consequently, the connection element 43 is settable in as many different rotationally fixed positions as there are first protrusions 49 at the lower end of the connection element 43.

Figure 8:
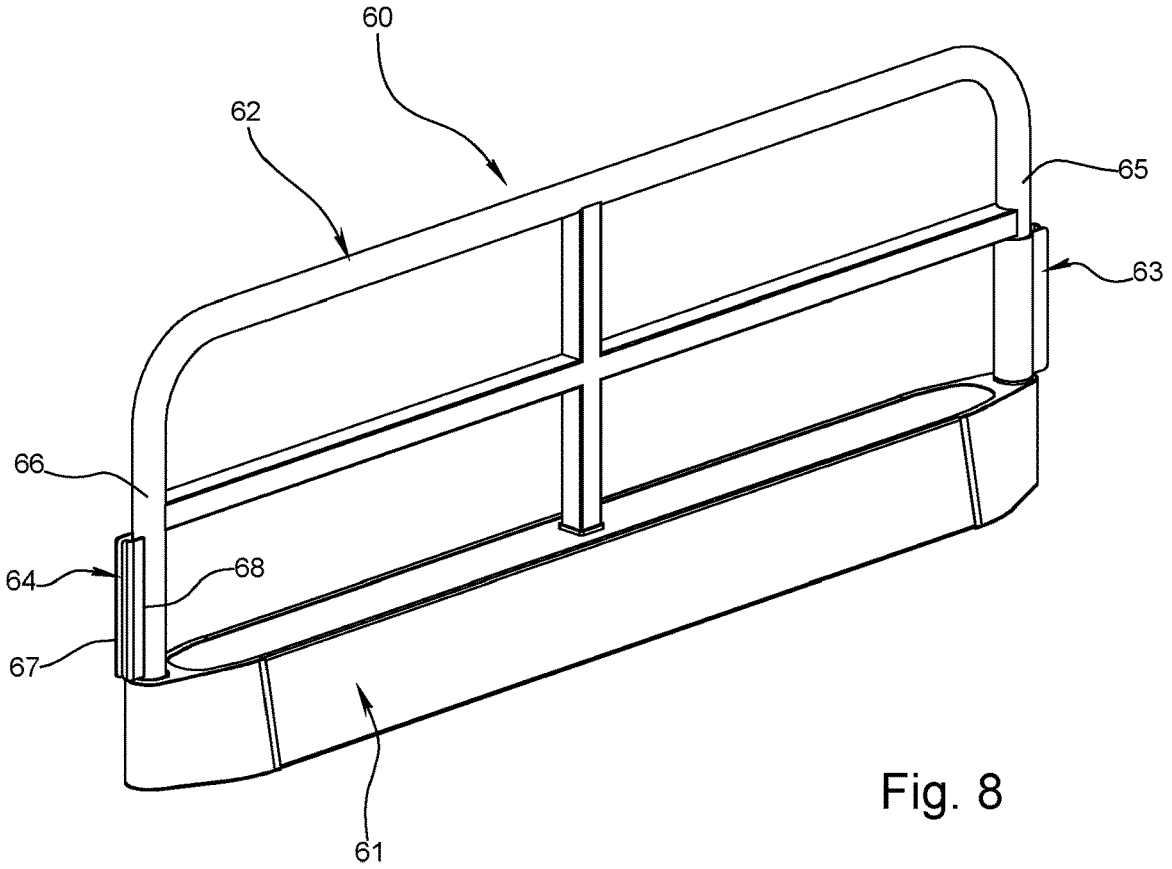

According to an embodiment of the heavy-duty barrier 60, shown in FIG. 8, having a base part 61 and a fence part 62, the heavy-duty barrier 60 further comprises a rigid first connection element 63, and a rigid second connection element 64. The first connection element 63 is rotatable about the bar portion 65 at one end of the heavy-duty barrier 60, and the second connection element 64 is fixedly attached to the bar portion 66 at the other, opposite, end of the heavy-duty barrier 60. The first connection element 63 can be any of the examples described herein and the like within the scope of the invention. The second connection element 64 comprises a hook portion 67 and an attachment portion 68. The attachment portion 68 may be merely welding strings or the like attaching the hook portion 67 to the bar portion 65. In this embodiment two neighbouring and interconnected heavy-duty barriers 60 are still pivotable relative to each other to be arranged at either in alignment with each other or at a horizontal angle to each other by connecting the first connection element 63 of one heavy-duty barrier 60 with the first connection element 63 or the second connection element 64 of the other heavy-duty barrier 60. However, by connecting two second connection elements 64 with each other the heavy-duty barriers 60 are fixed in horizontal alignment. If this option is undesirable the hook portions of the first and second connection elements 63, 64 may be shaped such that the hook portion 67 of the second connection element 64 is only interconnectable with the hook portion of the first connection element 63, and vice versa.

Figure 9:
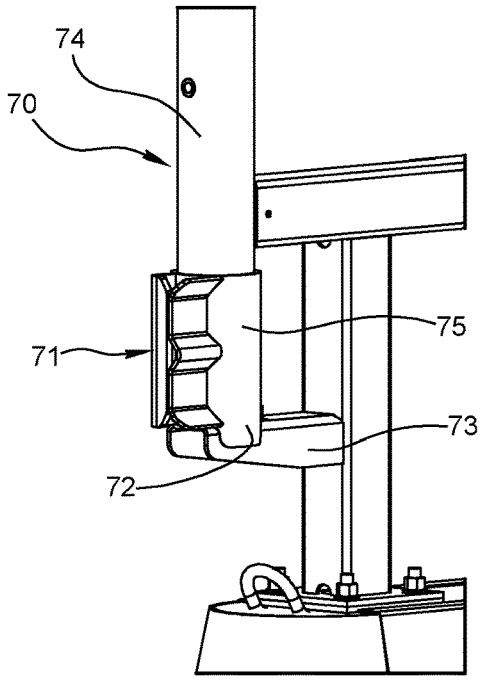

In accordance with an embodiment of the heavy-duty barrier 70, as shown in FIG. 9, the connection element, or first connection element, 71 is rotatable between rotationally fixed positions. The connection element 71, and more particularly the attachment portion 75 thereof, is provided with protrusions 72 at a lower end thereof. In a rotationally fixed position, the protrusions 72 extend along opposite side surfaces of the locking element 73, thereby preventing the connection element 71 from rotating. The connection element 71 is longitudinally movable along the bar portion 74 between the rotationally fixed position and a rotationally non-fixed position.

Figure 10:
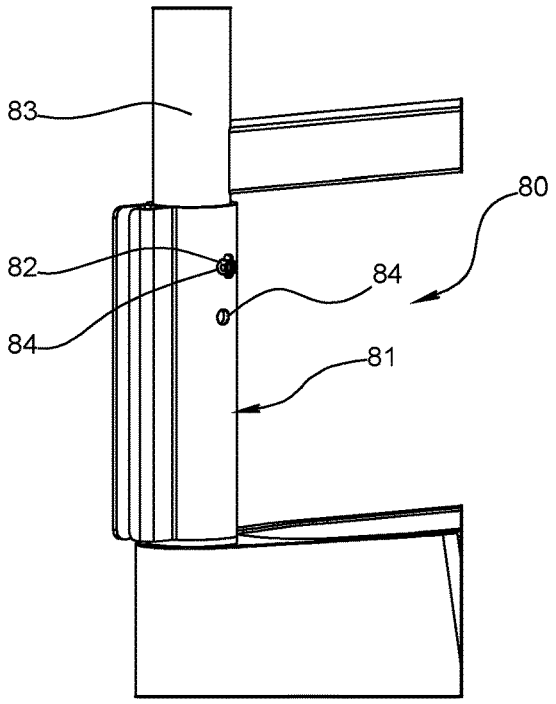

In accordance with an embodiment of the heavy-duty barrier 80, as shown in FIG. 10, the connection element, or first connection element, 81 is rotatable between rotationally fixed positions. The heavy-duty barrier 80 comprises a rotation blocking element 82 constituting a latch pin. The bar portion 83, at which the connection element 81 is rotationally and vertically movably mounted, as well as the connection element 81 are provided with borings 84 (not shown for the bar portion 83) arranged to receive the latch pin 82 as a through element, thus simultaneously extending through opposite borings 84 of the connection element 81 and aligned opposite borings of the bar portion 83. The borings of the bar portion may be made in, for instance, two orthogonal directions enabling the connection element 81 to be set in rotationally fixed positions with a rotationally angular spacing of 90 degrees, or at smaller angular distances. To facilitate small angular steps, the connection element 81 may be provided with two pairs of opposite borings 84, or more, arranged on top of each other at a vertical distance from each other, and matching pairs of opposite borings may be provided at varying heights of the bar portion 83.

Figure 11:
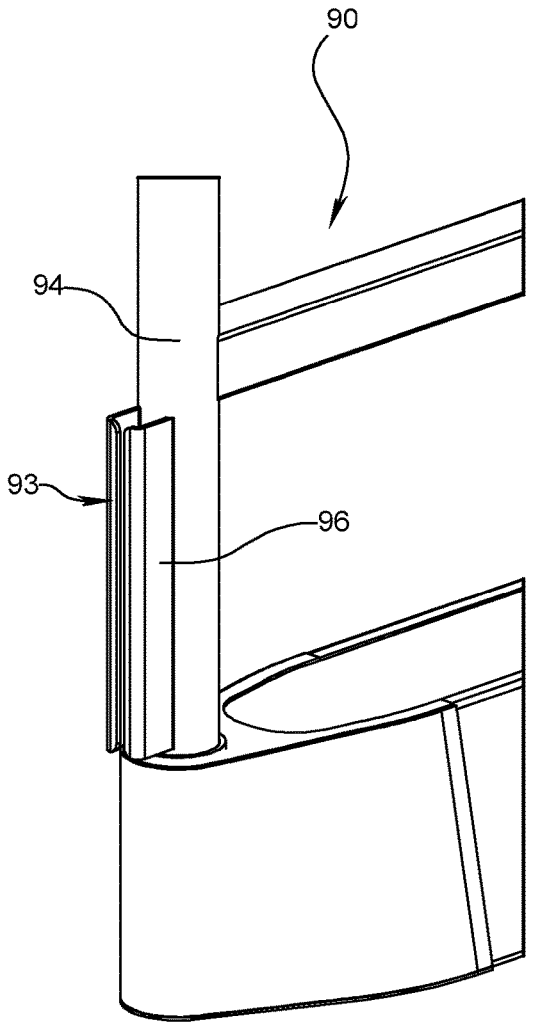
Figure 12:
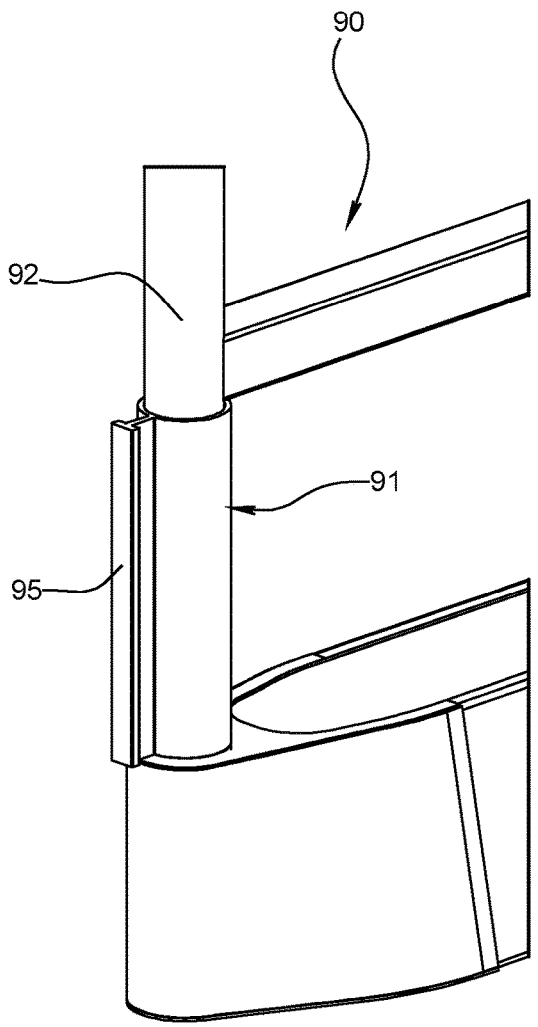

In an embodiment of the heavy-duty barrier 90, as shown in FIGS. 11 and 12, the heavy-duty barrier 90 comprises a first connection element 91 mounted at one end of the heavy-duty barrier 90, and a second connection element 93 mounted at the other, opposite, end of the heavy-duty barrier 90. Like in the above embodiments of the heavy-duty barrier, the first connection element is rotatably and longitudinally, i.e. vertically, movably attached to the bar portion 92. Like in the above embodiment containing a second connection element, the second connection element 93 is fixedly attached to the bar portion 94. Furthermore, like in the above embodiments of the heavy-duty barrier the connection elements are rigid. In this embodiment, the hook portions 95, 96 of the first and second connection elements 91, 93 differs from the other embodiments. The hook portion 95 of the first connection element 91 is T-shaped in cross-section, and the hook portion 96 of the second connection element 93 comprises two elongated portions being L-shaped in cross-section and facing each other defining a space between them, and a slot between the outer edges of the shorter leg of the L-shape. Thus, the shoulder portion of the T-shaped hook portion 95 of the first connection element 91 can be received in the space between the L-shaped portions of the hook portion 96 of the second connection element 93, with the waist portion of the T-shaped hook portion 95 extending through the slot.

While the invention has been illustrated and described in detail in the drawings and foregoing description, such illustration and description are to be considered illustrative or exemplary and not restrictive. The invention is not limited to the disclosed embodiments.

For instance, the fence part can be differently designed with fewer or more bars, differently shaped bars, etc., such as a short embodiment where the middle post has been omitted.

The connection element can be differently designed, for instance with a fully flat second protrusion, a U-shaped end portion of the first protrusion, etc., as long as it fulfils the task of being able to hook into a connection element of an adjacent heavy-duty barrier.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A heavy-duty barrier, which is movable, comprising a base part, which comprises a ballast, and a fence part attached to the base part, wherein the fence part comprises a fixed bar structure and a rigid first connection element, which is movably attached to the bar structure, wherein the first connection element comprises an attachment portion, movably attached to a bar portion of the bar structure and encircling at least a major part of a circumference of the bar portion, and a hook portion arranged to be engaged with a complementary hook portion of a rigid connection element of a neighboring heavy-duty barrier, wherein the movable attachment of the attachment portion includes rotation of the first connection element about a longitudinal center axis (C-C of the bar portion).

2. The heavy-duty barrier according to claim 1, wherein the movable attachment of the attachment portion includes movement along a length of the bar portion.

3. The heavy-duty barrier according to claim 1, wherein the attachment portion is tubular.

4. The heavy-duty barrier according to claim 1, wherein the hook portion comprises a first protrusion protruding from the attachment portion, and a second protrusion protruding from the attachment portion, wherein the first and second protrusions define a gap between them, which gap is arranged to receive a part of a first protrusion of the connection element of a neighboring heavy-duty barrier.

5. The heavy-duty barrier according to claim 4, wherein the first protrusion has an L-shaped cross-section, wherein a free end of the first protrusion faces the second protrusion.

6. The heavy-duty barrier according to claim 1, wherein the base part is made of concrete or is concrete fillable.

7. The heavy-duty barrier according to claim 1, wherein the first connection element is rotatably movable around the bar portion between several rotatably fixed positions.

8. The heavy-duty barrier according to claim 7, wherein the first connection element is arranged to be movable between the fixed positions by means of a combination of longitudinal movement and rotational movement.

9. The heavy-duty barrier according to claim 7, comprising a rotation blocking element fixedly arranged at the bar portion below the first connection element, and arranged to engage with the connection element to block rotation thereof.

10. The heavy-duty barrier according to claim 9, wherein the attachment portion comprises first protrusions extending downwards, and wherein the rotation blocking element comprises second protrusions extending upwards and engaging with the first protrusions.

11. The heavy-duty barrier according to claim 7, wherein the attachment portion comprises first protrusions extending downwards and arranged to engage with the bar structure to block rotational movement of the connection element.

12. The heavy-duty barrier according to claim 1, wherein the first connection element is freely rotatable to any position.

13. The heavy-duty barrier according to claim 1, comprising a rigid second connection element, wherein the first and second connection elements are arranged at opposite ends of the heavy-duty barrier, and wherein the second connection element is fixedly attached to the bar structure and is connectable with at least such a first connection element of a neighboring heavy-duty barrier.

* * * * *